US005168115A

United States Patent [19]

Hogrefe

[11] Patent Number: 5,168,115

[45] Date of Patent: Dec. 1, 1992

[54] MULTIPLE BANNER BATON

[76] Inventor: Peter Hogrefe, P.O. Box 211, Perrineville, N.J. 08535

[21] Appl. No.: 808,445

[22] Filed: Dec. 16, 1991

[51] Int. Cl.[5] ..... G10G 7/00

[52] U.S. Cl. ..... 84/477 B

[58] Field of Search ..... 84/477 B; D21/100; D11/166, 168, 181; 116/173

[56] References Cited

U.S. PATENT DOCUMENTS

D. 264,064 4/1982 Ornatek ..... D11/166

1,312,426 8/1919 Schmidt ..... D11/166

2,452,842 11/1948 Davis ..... 116/173

4,774,869 10/1988 Riksford ..... 84/477 B

*Primary Examiner*—Michael L. Gellner

*Assistant Examiner*—Cassandra Spyrou

*Attorney, Agent, or Firm*—Ira M. Adler

[57] ABSTRACT

The invention is an refers to a multiple flag marching baton which can be extended or hidden, respectively, such that the overall length of the baton remains constant for easier control.

2 Claims, 3 Drawing Sheets

MULTIPLE BANNER BATON

BACKGROUND

1. Field of the Invention

This invention relates to a baton used by a marching band which contains flags or banners at each end, such that the flag at one end may be exposed, while the flag at the other end is hidden from view. Alternately, the flags at both ends can be partially exposed at the same time. The overall length of the baton remains constant. This results in a dramatic marching presentation.

2. Description of Prior Art

Prior art, as exemplified by U.S. Pat. No. 4,774,869, attempted to produce an alternative banner effect by attaching one flag to an internal pole and the other flag to an external webbing. This arrangement results in the length of the baton changing depending on which flag is exposed. The extended baton shifts the center of gravity of the baton during use, making the manipulation of the baton difficult. In addition, the webbing can tear or stretch from use, causing a change in the feel of the baton over time.

The present invention, which consists of baton slidably inside a hollow slider, with half crescent shaped flags or banners attached at each end, results in a constant length baton, and a more stable center of gravity. Another advantage of the present invention over prior art is that the end flags, because of their circular cuts are easier to store and result in less wrinkling of the flags or banners.

SUMMARY OF THE INVENTION

This invention refers to a multiple flag baton.

The overall objective of the invention is to permit a marching band to alternately display two flags or banners, without changing batons. The changing of the flags is accomplished in a manner to keep the feel of baton stable and to preserve the flags after multiple use.

DETAILED DESCRIPTION

Figure 1:
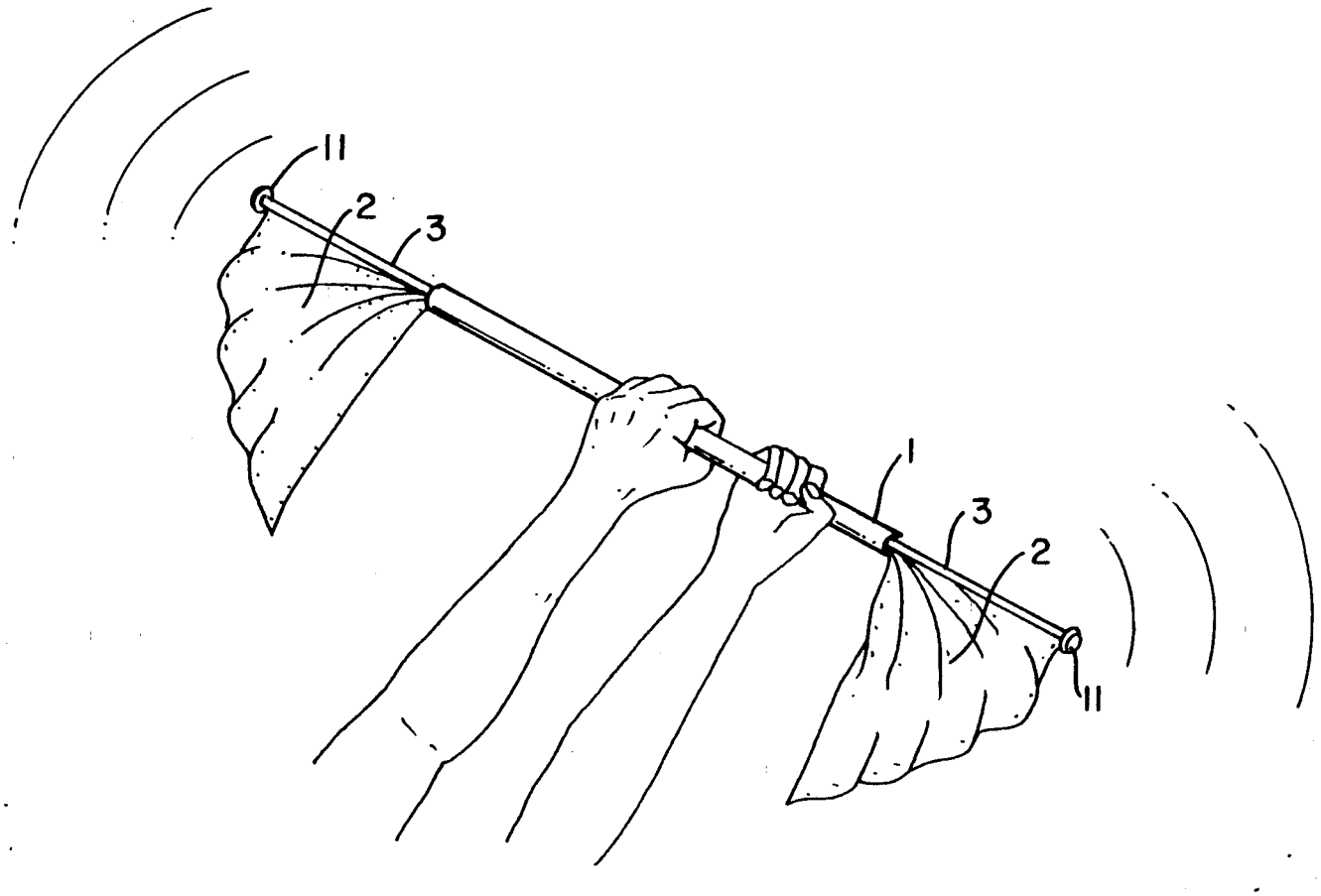
FIG. 1 is a perspective view of the baton with both end flags partially extended.

The invention is shown in FIG. 1 in a configuration with a marcher grasping the baton at the center of an outer slider 1. Both flags 2, which are attached to the flag holder 3 by a removable means, are shown in partially extended positions. A cap 11, which limits the longitudinal motion of the flag holder 3, is affixed to each end of the flag holder 3.

Figure 2:
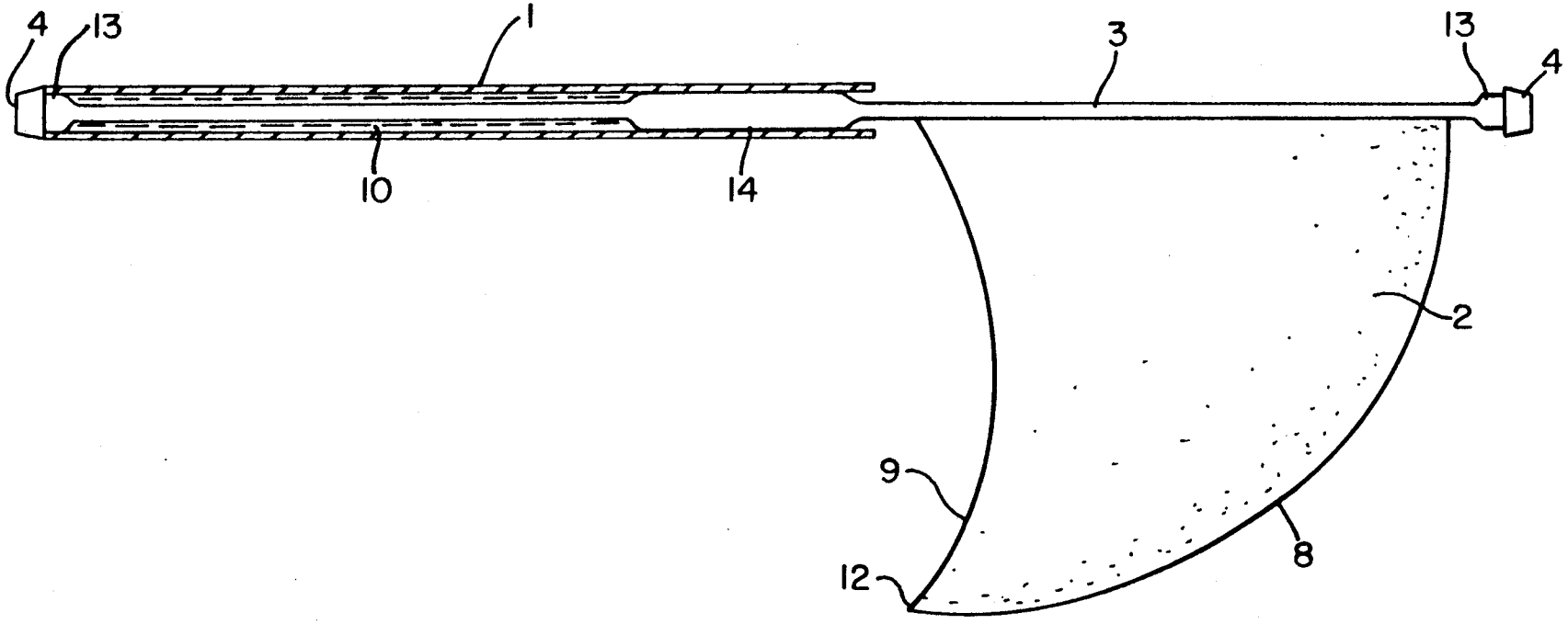
FIG. 2 is an elevation section view of the invention with one end flag fully extended and the opposite end flag fully hidden in a stored position.

The extended flag or banner is shown in FIG. 2. The leading edge 8 of the flag and the trailing edge 9 of the flag, are respectively of curvalinear shape such that the curves meet at the extremity of the flag 12. This configuration permits the easiest storage of the flags, when each is respectively in the hidden position. FIG. 2 also the opposite flag in an internally stored position 10.

Figure 3:
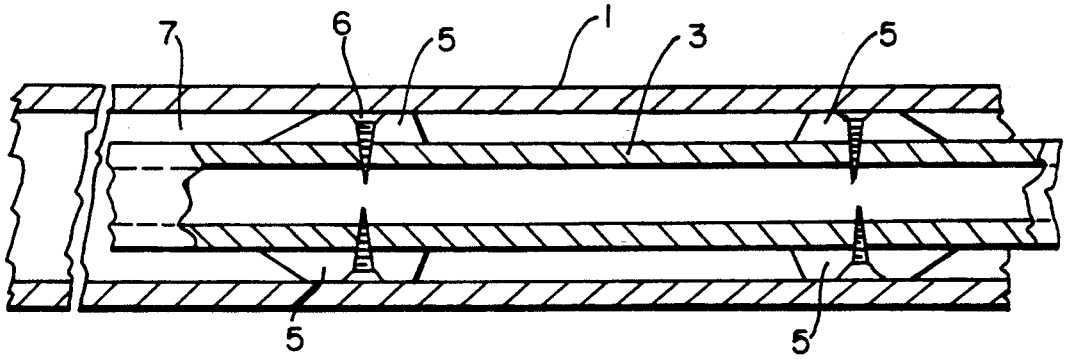
FIG. 3 is an elevation section view of attached internal pressure fittings.

As shown in FIG. 3, the flag holder 3 is slidably internal to the slider and is kept from sliding when in use by a multiplicity of pressure fittings 5 affixed to the outer walls of the flag holder at the central region of its length. When a flag 2 is fully extended, the opposite end cap 11, one of which is affixed to each end of the flag holder, limits the sliding motion of the flag holder within the slider. The extreme end 13 of the flag holder is the same Outside diameter as the inside diameter of the slider to keep the mechanism from wobbling.

Figure 4:
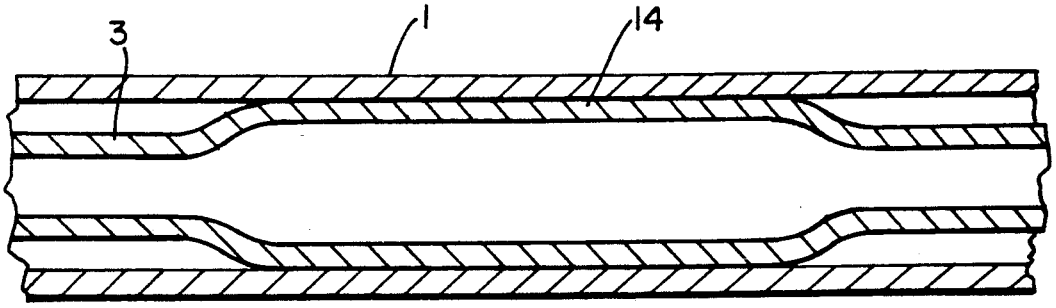
FIG. 4 is an elevation section view of an extruded internal pressure fitting.

In an alternative embodiment of the invention, as shown in FIG. 4, the flag holder has an enlarged diameter at its central region 14, and at the ends 13 which produces pressure on the inner wall of the slider, and holds the flag holder in place during use.

The flags or banners 2 may be attached to each end of the flag holder 3 by means of a longitudinal slit in the flag holder through which the flag is inserted, or secured by a Velcro means. The flags may thus be easily removed for replacement.

I claim:

1. A multiple flag marching baton, comprising:

a hollow cylindrical outer slider which is grasped by a marcher;

an cylindrical flag holder slidably internal to the outer slider;

a pair of flags attached lengthwise at each end of the cylindrical flag holder by a removable means whereby the leading and trailing edges of the said flag form a half crescent shape;

an end cap at each end of the cylindrical flag holder such that when the said cylindrical flag holder is slid lengthwise it is restricted from leaving the slider;

a multiplicity of pressure fittings affixed to the central region of the cylindrical flag holder to restrain the sliding motion of the cylindrical flag holder when the baton is in use.

2. The multiple flag marching baton in claim 1 wherein the diameter of the cylindrical flag holder is the same as the inner diameter of the slider whereby the sliding motion of the cylindrical flag holder is restrained.

* * * * *